United States Patent [19]

Lange

[11] 4,146,325

[45] Mar. 27, 1979

[54] METHOD AND APPARATUS FOR VISUALIZATION OF ELECTROSTATIC IMAGES

[75] Inventor: Gottfried Lange, Erlangen, Fed. Rep. of Germany

[73] Assignee: Siemens Aktiengesellschaft, Berlin & Munich, Fed. Rep. of Germany

[21] Appl. No.: 758,456

[22] Filed: Jan. 11, 1977

Related U.S. Application Data

[63] Continuation of Ser. No. 553,545, Feb. 27, 1975, abandoned.

[30] Foreign Application Priority Data

Mar. 4, 1974 [DE] Fed. Rep. of Germany ..... 2410188

[51] Int. Cl.[2] ..... G03G 15/00

[52] U.S. Cl. ..... 355/14; 118/7; 118/646; 355/3 DD; 355/4

[58] Field of Search ..... 355/3 DD, 4, 14; 118/654, 7, 646

[56] References Cited

U.S. PATENT DOCUMENTS

| | | | |
|---|---|---|---|
| 3,430,606 | 3/1969 | Pease et al. | 118/646 |
| 3,778,146 | 12/1973 | Knapp | 355/3 DD |
| 3,872,825 | 3/1975 | Davidson | 355/3 DD |
| 3,873,197 | 3/1975 | Whited | 355/3 DD |

*Primary Examiner*—Richard L. Moses

*Attorney, Agent, or Firm*—Hill, Gross, Simpson, Van Santen, Steadman, Chiara & Simpson

[57] ABSTRACT

A method and apparatus for effecting the visualization of electrostatic images. During the deposition of the pigment in the developing area, the absorption of light is measured at least at one part of the surface of the image so as to form a signal, and that the further supply of pigment is controlled in accordance with this signal. Through the control, meaning the termination or break off of the developing sequence upon reaching of a predetermined image coating, respectively, color depth, such as darkening, there is obtained the identical picture characteristics for all exposures.

4 Claims, 1 Drawing Figure

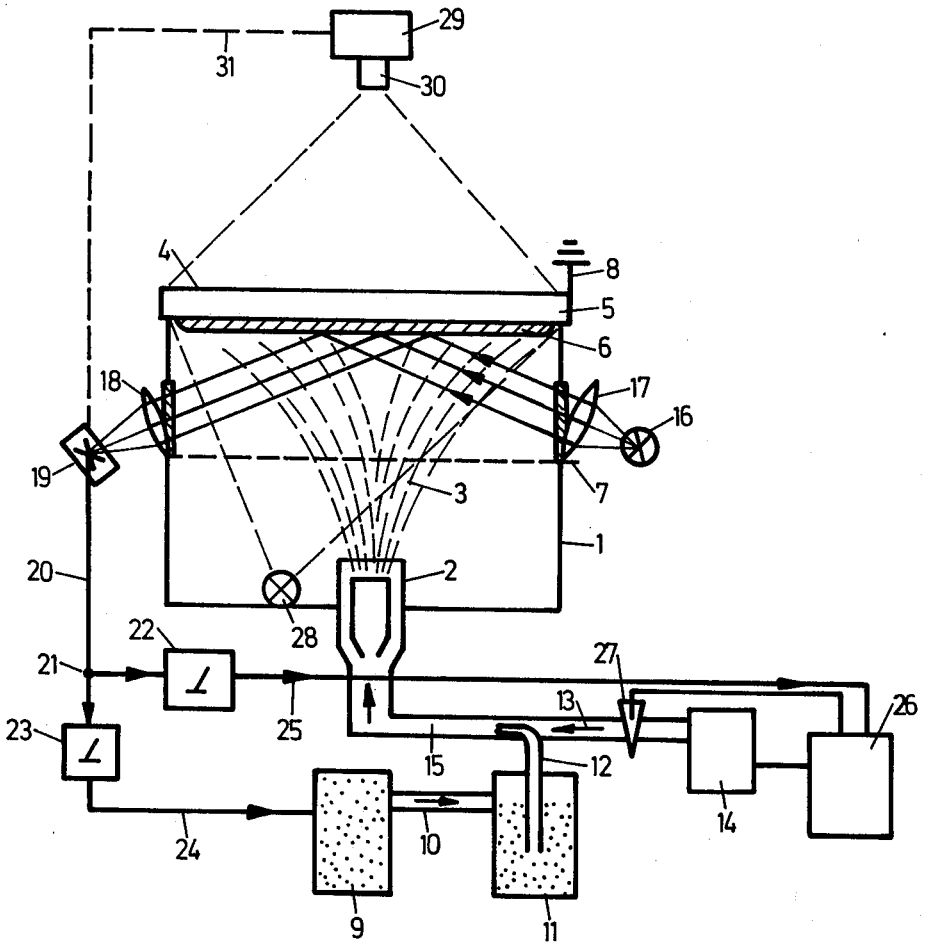
29
31
30
4
8
5
6
18
17
16
19
3
7
1
20
2
28
22
21
27
13
26
23
25
15
12
14
24
10
9
11

METHOD AND APPARATUS FOR VISUALIZATION OF ELECTROSTATIC IMAGES

This is a continuation of application Ser. No. 553,545, filed Feb. 27, 1975 now abandoned.

FIELD OF THE INVENTION

The present invention relates to a method and apparatus for effecting the visualization of electrostatic images.

Methods and installations for visualizing or rendering visible electrostatic images wherein a signal, which is derived from the image, is employed for the control of the developing sequence, meaning, for the control of the deposition of colored pigment, are currently known from the journal "Physical Medical Biology" 18 (1973) No. 1, pages 3 through 37 and, in particular, pages 19 through 23.

DISCUSSION OF THE PRIOR ART

In the production of electrophotographic pictures it is known that the brightness distinctions which occur in the picture surface may be converted into a corresponding distribution of electrical charges. The foregoing generally results from in that a photoconductive layer which has been charged, for example, by means of a corona discharge to a few thousand volts, is subjected to the radiation for rendering it visible, such as an X-radiation. Thereby, the photoconductor obtains varying conductivities at the irradiated locations thereof, which are dependent upon the distinctions in the density of the rays. This has the effect, that the applied charge is partially discharged in dependence upon the image which is to be rendered visible or visualized. Remaining on the layer is a so-called charge distribution or pattern, in which the charge levels are so distributed as to provide a charge image corresponding to the radiation image.

A production of charge images is also possible through the intermediary of ionography, meaning, the image-like distributed charges are applied onto an insulating layer. For this purpose, there is utilized the ionization in the gases which has been effected by the rays, and this provides the capability that the ions which are formed there may be caused to migrate by means of an electrical field. The ions which are thus formed in a gas chamber, deposit themselves on an insulating foil which is located in front of an electrode. In the formation of an X-ray, gamma ray, and the like, radiation exposure, used in ionography, analogous to the use of the cassette in exposures, on the photofilm, is a room which encompasses a gas chamber between electrodes. The rays therein pass through one of the electrodes, meaning, through a ray-transmissive, electrically conductive layer, into the gas layer whose other border is defined by the second electrode, the latter of which is coated with an insulating layer. Through the application of a voltage an electrical field is generated in the gas chamber, whereby the ions will migrate. Since the reason for the generation of the ions lies in the penetrating rays and in their intensity distribution, in this manner there is thus obtained an electrical charge image.

For effecting the visualization of the charge images which are obtained in accordance with the above-mentioned methods, the so-called latent electrostatic images, finely-divided colored pigment (so-called toner) is applied to the surface, which carries the charge pattern, in the form of a dust cloud. From the latter, in conformance with the charge distribution, differently thick coatings remain adhering to the surface. The image which has been rendered visible by means of the colored particles subsequently may then be fixed either on the surface on which it has been formed or, in a known manner, may be transferred to another carrier, such as a sheet of paper, and only then fixed thereon. On the other hand, it is also possible that the charge image may itself be transferred to another carrier prior to its actual development with colored pigment, and to be only then developed.

In the utilization of the above-mentioned electro-radiography it has been ascertained, particularly in connection with the X-ray exposure technology, that it is of disadvantage in the required degree of comparability of pictures for medical applications, in that the color depth, such as the darkening, which conforms to the quantity of deposited colored particles, and which determines the ability to recognize the finest anatomical details, is extremely differing. This is particularly based on that, through the toner injection system employed in known apparatus, there occurs a frequently significant variation in the quantity of the sprayed toner, meaning, the concentration of colored pigment, in the developing chamber. However, the color depth depends upon the concentration of the particles, and from the former the degree of comparability of the pictures.

SUMMARY OF THE INVENTION

Accordingly, it is an object of the present invention to provide, for methods and installations for effecting the visualization of electrostatic charge images of the type mentioned hereinabove that, even for different values of the charge of the images, there are obtained comparable visual pictures possessing good detail recognizability.

The foregoing object is inventively achieved in that during the deposition of the pigment in the developing area, the absorption of light is measured at least at one part of the surface of the image so as to form a signal, and that the further supply of pigment is controlled in accordance with this signal.

Through the control, meaning the termination or break off, of the developing sequence upon reaching of a predetermined image coating, respectively, color depth, such as darkening, there is obtained the identical picture characteristics for all exposures. This has the result that there is an improvement in the recognizability of medically important details since no underdeveloped or, respectively, overdeveloped electrical radiophotographic pictures are produced. Furthermore, other advantages, as follows, are obtained: uniform picture characteristics for exposures produced at different times, and better recognizability of important minutest details.

The inventive teaching, above all, is utilizable for applicable methods in the development of electrostatic charge images, in which the pigment which is employed for the developing is fed in, and wherein this infeed is controllable. The teaching is also applicable to other methods besides that in the method for pigment dusting, such as methods in which the pigment is employed within liquids, such as being dispersed therein.

In connection therewith, the interruption or break of in the supply of the developing pigment may be controlled through the use of an optical signal which may serve as an integral value for the density of the obtained visible picture. One such picture is generally obtained in that the surface of the picture is irradiated with a test light, such as infrared light, and wherein the reflected light is then utilized as the measure for the image coating. For example, the light may be converted into measuring signals in an electro-optical converter. Through these signals it then becomes possible to terminate the supply and, respectively, production of the distribution of the pigments upon the obtaining of a predetermined value.

The winning of the control signal through reflection at the surface of the image may be always of the great advantage when the image carrier is constituted of a good reflective material, such as a metal, for example, aluminum, and that it provides a light which will penetrate through the material of the photoconductor without influence on its electrical properties. Thereby, the light signal, namely, is not unnecessarily weakened through poor reflective properties, or respectively, strong absorption. However, there may also be of advantage an irradiation method when the carrier is transmissive to the test light. This is the case, for example, in the visualization of charged images which are located on the surface of transparent carriers. Such as used in the production of ionographic pictures. For effecting the measurement, a light source is positioned opposite the image. The light which without hinderance passes through the image in dependence upon the degree of development, may then be transmitted, as in the reflection method, through electro-optical conversion into a measuring signal for the coating of the image. By means of this signal, there may then be carried out the control of the supply of pigment.

BRIEF DESCRIPTION OF THE DRAWING

Reference may now be had to the following detailed description of an exemplary embodiment of the apparatus for the visualization of electrostatic images pursuant to the present invention, taken in conjunction with the single FIGURE of the accompanying drawing.

DETAILED DESCRIPTION

The arrangement for the development of electrostatic images, in a known manner, consists of a chamber 1 within which there is produced, by means of a spray nozzle 2, a cloud 3 of finely divided particles of a colored pigment. The size of the grains of the pigment, the latter of which may consist of polystyrol, polyvinyl, polyethylene or the like, consists of 2 to 10μ. This cloud is also conveyed against an opening in the chamber 1, which is closed off by means of a plate 4. This plate 4 carries the electrostatic image. The plate consists of an approximately 2 mm thick support plate 5 which is constructed of aluminum, and which is coated by a layer 6 of selenium having a thickness of 150 to 500μ.

Produced on the layer 6 is a known manner, as indicated in the description hereinabove, is an electrostatic image. The latter effects that the pigment formed of cloud 3 is retained thereon in an image-like distribution. For the control of the picture characteristics there may be applied to the grid 7, in a known manner, a field strength of plus or minus 300 to 400 volt/cm as compared to the grounded line 8, or a negative high voltage of 2000 to 5000 volt applied to plate 4. As known, there is consequently achieved that the strong edge definition which will occur in xerography may be reduced and the gray definitions, particularly of planar-shaped shadows of medical objects, better represented. Furthermore, by means of a negative voltage on the aluminum substrate relative to the positive charge of the selenium surface, the level of the charge of the image may be reduced as desired and, upon occasion, an image inversion may be achieved.

For actual developing, the powder contained in receptacle 9 is formed of polystyrol, polyethylene or the like. The powder is conveyed through conduit 10 into the receptacle 11. From the latter, the powder is then conveyed through injection nozzle 12 by means of the air stream which is indicated by arrow 13, the latter coming from a compressor 14 into a conduit 15 which communicates through nozzle 2 with the chamber 1. For generating the signals which are necessary for effecting the control, by means of a light source 16 and an optical system 17, a light beam is projected against the surface of the layer 6. The reflected light is then transmitted through an optical system 18 from the direction of the reflective angle into an electro-optical beam converter cell 19, which may be constituted of a known detector of germanium, silicon, lead sulfide, or the like. From there, the signal is transmitted through a conductor 20 across the distributor point 21 into two boundary value transmitters 22 and 23. These are measuring apparatus, which, for example, are constructed as transistor-amplifiers with thereto connected flip-flops so as to form boundary value switches, so that an electrical signal is emitted at an adjustable preset value. The boundary value indicator 23 trus, through the conduit 24, controls the delivery of powder from the receptacle 9. The boundary value transmitter 22, by means of the conductor 25, and through the timer 26, the latter of which is a bistable multivibrator, controls the compressor 14 and, respectively, the magnetic valve 27.

The operative effect is provided in that, through the time device 26, the control valve 27 impulse-wise delivers to the injection nozzle 12 an air pressure of approximately 0.6 to 0.8 atmospheres which is supplied by the compressor 14, and then through the conduit 15 to the toner supply nozzle 2. The control is carried out in a manner whereby approximately 10 powder ejections are initiated within a minute through action of the timer 26. Thereby, as a rule, there may be obtained usable developed pictures.

The foregoing arrangement is so arranged whereby the thickness of the coating of toner, or respectively, the darkening of the surface of the layer 6, the latter of which consists of selenium, may be so controlled that, by providing a predetermined end value, the powder supply or feed is interrupted. Selenium readily permits passage of greater than 1 μm of light in the range of infrared light, so that the infrared light which emanates from the source 16 is reflected from the surface of the aluminum plate 4 and is then transmitted into the silicon-containing electro-optical converter 9 effective as a detector element. The infrared light which is to be utilized at a wave length of greater than 1 μm has no influence on the charge patterns on the semiconductor layer 6, since the energy of the light quantities is so minute that no paired charge carriers or particles are formed within the layer. By means of the lens system of the two objective systems 17 and 18 there is accordingly obtained a representative image cross-section of the picture which is to be developed for the generation of the control signal.

As is shown in the drawing, the developing image is disposed at a location in which particles of the developer, or developing agent are finely distributed, for example, in a cloud-like formation. A light beam, generated by a light source 16 then impinges on the layer 6 of the image. A portion of the light beam passes through the layer 6, another portion of the light beam is absorbed within the layer 6, and a third portion of the light beam is reflected from the layer 6. The quantitative magnitudes of the aforesaid light-beam portions are dependent on the amount of pigment in the layer 6, i.e. a thick layer of pigment absorbs more light than it reflects. The image is devoid of any pigment when entering the location referred to above, pigment being only applied to the image during the developing process. By measuring the reflection and/or absorption a signal can be obtained by means of which it is possible to control the development in dependence of the developing state of the image. The coating thickness of the image can thus be controlled, according to the invention, by obtaining a pigment coverage, or blackening of the image, which remains constant and independent of the amount of the electrostatic charge applied. Thus, starting with a given charge, it is possible to always obtain identical images; it is merely necessary that the coating thickness of the image be controllable.

Upon reaching a predetermined coating thickness, which may be set by the boundary value transmitters 22 and 23, the supply of toner is interrupted. For this purpose, the valve 27 is closed by means of electrical impulses. If, through the transmitter 22, the signal which is continuously received from the detector 19 is impulsewise processed only during the time intervals between the impulses of the powder ejections which are generated by the compressor 14 then, under otherwise identical conditions, it delivers a cut-off impulse which is dependent only upon the image coating. Within the pauses during which no powder egresses from the nozzle 2, the density of the cloud 3 in the developing chamber, meaning, the chamber 1, is so extensively tranquilized, that the infrared signal is not disturbed by irregularities in the distribution of floating particles.

At continuous powder infeed, the control must be modified in contrast with the previously described manner of operation in that a predetermined zero signal, which is caused by the concentration of the floating pigment particles in the powder cloud, is given as the threshold value. Hereby, it is at all times a requirement that the powder cloud always have a constantly density and remains unchanged from developing to developing. The cut-off signal may also be obtained by means of an IR-detector 19 after the reaching of a predetermined darkening value, as in the above-described arrangement.

Through the automatic control of the darkening there is also obtained the possibility that after exceeding a determinate preset number of powder ejections, approximately 10 to 20, or at a predetermined time, approximately after 2 to 3 minutes, a signal is transmitted to the powder refill arrangement of the receptacle 9, whereby a sufficient amount of powder is again contained in the injector receptacle 11. This affords the advantage that the powder supply in the receptacle 11 is always sufficiently adequate in order to obtain optimally darkened radiographic exposures.

At the location of plate 4 there may also be positioned a light-transmissive carrier for a charge image. Hereby it is also possible to generate the control signal in the penetrating light. For this purpose there is provided a light source 28 which illuminates the charged side of the carrier used in lieu of plate 4. Located on the external side of the chamber 1 is a measuring probe 29 with its objective lens 30 directed towards the carrier which is used in lieu of the plate 14, so that the penetrating light is received by the electro-optical element of the probe 29. The measuring signal may then be utilized, by means of phantom-illustrated conductor 31, in the same manner as the signal emitted from the probe 19 so that here also it is possible to exert control over the developing.

While there has been shown what is considered to be the preferred embodiment of the invention, it will be obvious that modifications may be made which come within the scope of the disclosure of the specification.

What is claimed is:

1. In a method for the visualization of electrostatic charge images, including deriving an electrical signal by electro-optical means from said images for control of a developing process for said images, said control being over the deposition of colored pigment, the improvement comprising: absorbing light at least at a portion of the surface of the charge image during the deposition of the pigment in the developing area, measuring the absorption of light at the charge image by generating with the use of the electro-optical means the electrical signal from non-absorbed light, feeding the generated electrical signal to control means for a pigment supply, and terminating the subsequent pigment supply to the developing image in response to the electrical signal reaching a predetermined value.

2. A method as claimed in claim 1, said charge image being disposed on a light-transparent carrier, said electrical signal determining the light-transmissiveness of said carrier and the pigment deposited thereon.

3. In an apparatus for the visualization of electrostatic charge images including an electro-optical converter for deriving an electrical signal from said images for control of a developing process for said images, said apparatus including a developing area, means for depositing colored pigment in said developing area to form an image; said electro-optical converter being responsive to non-absorbed light for measuring the absorption of light on at least a portion of the surface of said image during the deposition of said pigment in the developing area; and means for controlling the subsequent supply of said pigment responsive to said electrical signal, the improvement comprising: a developing arrangement including a chamber within which said pigment is deposited on said charge image; a light source for projecting a light beam on the surface adapted to be coated with pigment; and the electro-optical converter being located in the path of said light after impingement on said surface and being operatively responsive thereto to generate said electrical signal, said control means for the supply of said pigment having adjustable threshold forming means for supplying a cut-off signal thereto, said threshold forming means being operatively connected to said electro-optical converter and operable to supply the cut-off signal to said control means when the electrical signal from the converter reaches a selected value, said control means being responsive to said cut-off signal for terminating the supply of said pigment.

4. An apparatus as claimed in claim 3, comprising a light-transmissive carrier, said light source being located on one side of said carrier and a light probe of said converter on the other side thereof.

* * * * *